US008632161B2

(12) United States Patent
Kuwata et al.

(10) Patent No.: US 8,632,161 B2
(45) Date of Patent: Jan. 21, 2014

(54) LIQUID EJECTION HEAD AND IMAGE FORMING APPARATUS INCLUDING THE LIQUID EJECTION HEAD

(75) Inventors: Masahiro Kuwata, Kanagawa (JP); Daisuke Takagi, Kanagawa (JP); Kazuo Haida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 136 days.

(21) Appl. No.: 13/231,464

(22) Filed: Sep. 13, 2011

(65) Prior Publication Data

US 2012/0069093 A1 Mar. 22, 2012

(30) Foreign Application Priority Data

Sep. 16, 2010 (JP) ..... 2010-207593

(51) Int. Cl.
*B41J 2/14* (2006.01)
*B41J 2/16* (2006.01)

(52) U.S. Cl.
USPC ..... 347/47

(58) Field of Classification Search
None
See application file for complete search history.

(56) References Cited

U.S. PATENT DOCUMENTS

2009/0244188 A1* 10/2009 Ito ..... 347/54
2010/0214378 A1 8/2010 Katoh et al.
2010/0225716 A1 9/2010 Hayakawa et al.
2010/0277555 A1 11/2010 Katoh et al.
2010/0295908 A1 11/2010 Katoh et al.
2011/0025789 A1 2/2011 Kuwata et al.
2011/0050819 A1 3/2011 Bannai et al.
2011/0164078 A1 7/2011 Katoh et al.

FOREIGN PATENT DOCUMENTS

JP 2001-353871 12/2001
JP 2006-347036 12/2006
JP 4151955 7/2008

OTHER PUBLICATIONS

Machine Translation of JP2006347036A.*

* cited by examiner

*Primary Examiner* — Lisa M Solomon
(74) *Attorney, Agent, or Firm* — Cooper & Dunham LLP

(57) ABSTRACT

A liquid ejection head includes a common-chamber formation member including a common chamber to supply liquid to pressure chambers communicating nozzles for ejecting liquid droplets, a flexible thin-film member to form part of a wall face of the common chamber, and a thin-film support member bonded to the thin-film member with glue. The support member has an opening or a recessed portion at least partially having a shape that is broad in an area proximal to a first surface of the support member bonded to the thin-film member and becomes narrower as an area of the opening or the recessed portion is more distant from the first surface. The opening or the recessed portion is sealed with the thin-film member. A portion of the thin-film member corresponding to the opening or the recessed portion has the glue on only a periphery area of the portion that contacts the support member.

9 Claims, 11 Drawing Sheets

LIQUID EJECTION HEAD AND IMAGE FORMING APPARATUS INCLUDING THE LIQUID EJECTION HEAD

CROSS-REFERENCE TO RELATED APPLICATIONS

This patent application is based on and claims priority pursuant to 35 U.S.C. §119 to Japanese Patent Application No. 2010-207593, filed on Sep. 16, 2010 in the Japan Patent Office, the entire disclosure of which is hereby incorporated herein by reference in its entirety.

TECHNICAL FIELD

This disclosure relates to a liquid ejection head and an image forming apparatus including a liquid ejection head.

DESCRIPTION OF THE BACKGROUND ART

Image forming apparatuses are used as printers, facsimile machines, copiers, plotters, or multi-functional devices having two or more of the foregoing capabilities. As one type of image forming apparatus employing a liquid-ejection recording method, for example, an inkjet recording apparatus is known that uses a recording head serving as a liquid ejection head (liquid-droplet ejection head) to eject droplets of ink. During image formation, such liquid-ejection-type image forming apparatuses eject droplets of ink or other liquid from the recording head onto a recording medium to form a desired image.

Such liquid-ejection-type image forming apparatuses fall into two main types: a serial-type image forming apparatus that forms an image by ejecting droplets from the recording head while moving the recording head in a main scanning direction of the carriage, and a line-head-type image forming apparatus that forms an image by ejecting droplets from a linear-shaped recording head held stationary in the image forming apparatus.

The liquid ejection head has, for example, nozzles to eject liquid droplets, individual pressure chambers (also referred to as pressurizing chambers, ejection rooms, and liquid channels) communicating the nozzles, pressure generation units (energy generation units) to generate pressure (energy) for pressurizing liquid within the pressure chambers, and common chambers of a relatively large volume to supply liquid to the pressure chambers. Pressure generated by the pressure generation units pressurizes liquid within the pressure chamber to eject liquid droplets from the nozzles.

The pressure generation units are, for example, thermal actuators that generate film boiling of liquid (ink) by electrothermal transducers, such as heat-generation resistant, to cause a phase change, piezoelectric actuators employing, e.g., piezoelectric elements (used as a synonym for electro-thermal transducers in this disclosure), or electrostatic actuators that generate pressure by electrostatic force.

For the liquid ejection head, it is necessary to raise the internal pressure of the individual pressure chambers to eject liquid droplets. The pressure generated at this stage causes liquid droplets to be ejected from the nozzles and, at the same time, is transmitted to the common chambers. The pressure may be transmitted back to the individual chambers, thus causing unexpected fluctuations in the internal pressure of the individual pressure chambers. Such fluctuations hamper droplet ejection at a desired speed and amount, thus causing ejection failure. In particular, in a case in which a plurality of individual pressure chambers is simultaneously pressurized to eject liquid droplets, the pressure transmitted from the individual pressure chambers to the common chambers becomes relatively great, which tends to cause ejection failure. In addition, if the fluctuations in pressure transmitted to the common chambers are transmitted to adjacent pressure chambers to affect liquid in the pressure chambers, that is, mutual interference occurs, leak or ejection of liquid droplets from unintended nozzles or unstable ejection state may be caused. As a result, outputting high quality images may be hampered.

In particular, in a case in which the driving frequency of pressure generation units is raised to increase image formation speed and image quality, such reflection of the pressure transmitted from the individual pressure chambers to the common chambers may cause complex behavior of pressure in the pressure chambers, thus hampering accurate ejection of liquid droplets. Alternatively, in a case in which an increased number of nozzles are used, the shape of the common chambers may be tapered toward end portions in the longitudinal direction of the common chambers. In such a case, at the longitudinal end portions of the common chambers, pressure fluctuates relatively greatly, thus giving more influence to the individual pressure chambers than a longitudinal middle portion of the common chambers. As a result, a difference in the behavior of pressure may occur between positions of the individual pressure chambers in the nozzle array direction, thus hampering proper control of the behavior of pressure.

Therefore, it is preferable to minimize such fluctuations in the internal pressure of the common chambers and the difference in the behavior of pressure between positions of the individual pressure chambers in the nozzle array direction.

Hence, conventionally, a damper may be disposed to absorb or minimize fluctuations in the internal pressure of the common chambers. However, because a damper formation member formed of a thin film material is quite thin to perform the function as a damper, it is difficult to retain the damper formation member by itself. Hence, conventionally, a thin film member and a substrate for supporting the thin film member may be integrated and machined so as to leave the thin film member in a damper portion. For example, JP-2001-353871-A and JP-2006-347036-A propose to use a clad member in which a thin film member is bonded to a plate member, etch the plate member to form a damper chamber, and use the thin film member as a damper.

However, as described in JP-2001-353871-A and JP-2006-347036-A, in a case in which the clad member in which the thin film member is bonded to the plate member is used, glue for bonding the thin film member to the plate member remains on the thin film member. Such residual glue increases the hardness of a portion of the thin film member that acts as the damper or causes deformation due to a difference in coefficient of linear expansion between the thin film member and the glue, thus hampering proper damper performance of the thin film member.

BRIEF SUMMARY

In an aspect of this disclosure, there is provided a liquid ejection head including a common-chamber formation member, a flexible thin-film member, and a thin-film support member. The common-chamber formation member includes a common chamber to supply liquid to a plurality of pressure chambers communicating a plurality of nozzles for ejecting liquid droplets. The flexible thin-film member forms part of a wall face of the common chamber. The thin-film support member is bonded to the thin-film member with glue. The thin-film support member has one of an opening and a recessed portion at least partially having a shape that is broad in an area proximal to a first surface of the thin-film support member bonded to the thin-film member and becomes narrower as an area of the one of the opening and the recessed portion is more distant from the first surface of the thin-film support member bonded to the thin-film member. The one of the opening and the recessed portion of the thin-film support member is sealed with the thin-film member. A portion of the thin-film member corresponding to the one of the opening and the recessed portion of the thin-film support member has the glue on only a periphery area of the portion of the thin-film member that contacts the thin-film support member.

In another aspect of this disclosure, there is provided an image forming apparatus including the above-described liquid ejection head.

In still another aspect of this disclosure, there is provided a method of making a liquid ejection head having a common-chamber formation member including a common chamber to supply liquid to a plurality of pressure chambers communicating a plurality of nozzles for ejecting liquid droplets, a flexible thin-film member to form part of a wall face of the common chamber, and a thin-film support member bonded to the thin-film member with glue. The method includes forming, in the thin-film support member, one of an opening and a recessed portion at least partially having a shape that is broad in an area proximal to a first surface of the thin-film support member bonded to the thin-film member and becomes narrower as an area of the one of the opening and the recessed portion is more distant from the first surface of the thin-film support member bonded to the thin-film member; applying the glue to an area other than the one of the opening and the recessed portion of the first surface of the thin-film support member bonded to the thin-film member; bonding the thin-film member bonded to a slightly-adhesive film to the first surface of the thin-film support member to seal the one of the opening and the recessed portion of the thin-film support member; and separating the slightly-adhesive film from the thin-film member in a state in which the glue is preliminarily or fully hardened.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
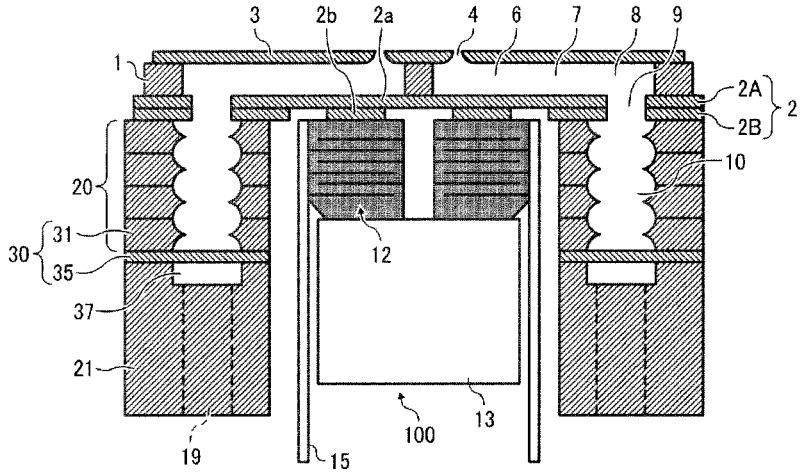
FIG. 1 is a cross-sectional view of a liquid ejection head according to a first exemplary embodiment of this disclosure cut along a direction (chamber longitudinal direction) perpendicular to a direction (nozzle array direction) in which nozzles of the liquid ejection head are arrayed in row.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In this disclosure, the term "image forming apparatus" using a liquid ejection recording method refers to an apparatus that ejects ink or any other liquid on a medium to form an image on the medium. The medium is made of, for example, paper, string, fiber, cloth, leather, metal, plastic, glass, timber, and ceramic. The term "image formation", which is used herein as a synonym for "image recording" and "image printing", includes providing not only meaningful images such as characters and figures but meaningless images such as patterns to the medium. The term "ink" used herein is not limited to "ink" in a narrow sense and includes anything useable for image formation, such as a DNA sample, resist, pattern material, washing fluid, storing solution, and fixing solution. The term "sheet" used herein is not limited to a sheet of paper and includes anything such as an OHP (overhead projector) sheet or a cloth sheet on which ink droplets are attached. In other words, the term "sheet" is used as a generic term including a recording medium, a recorded medium, a recording sheet, and a recording paper sheet. The term "image" used herein is not limited to a two-dimensional image and includes, for example, an image applied to a three dimensional object and a three dimensional object itself formed as a three-dimensionally molded image.

Referring now to the drawings, wherein like reference numerals designate identical or corresponding parts throughout the several views, exemplary embodiments of the present disclosure are described below.

First, a liquid ejection head according to a first exemplary embodiment of this disclosure is described with reference to FIGS. 1 and 2.

Figure 2:
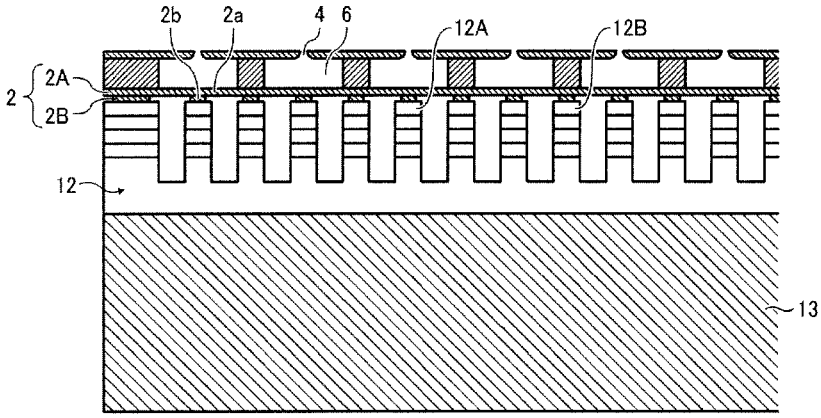
FIG. 2 is a front view of the liquid ejection head cut along the nozzle array direction.

FIG. 1 is a cross-sectional view of the liquid ejection head cut along a direction (chamber longitudinal direction) perpendicular to a direction (nozzle array direction) in which nozzles of the liquid ejection head are arrayed in row. FIG. 2 is a front view of the liquid ejection head cut along the nozzle array direction.

The liquid ejection head includes a channel member (chamber substrate) 1 made of a stainless steel (SUS) substrate, a diaphragm member 2 bonded to a lower face of the channel member 1, and a nozzle plate 3 bonded to an upper face of the channel member 1. The channel member 1, the diaphragm member 2, and the nozzle plate 3 form a plurality of pressure chambers 6, a plurality of fluid resistance portions 7, and a plurality of connecting portions 8. The plurality of pressure chambers 6 (also referred to as liquid chambers, pressurizing chambers, pressure rooms, pressurizing rooms, or channels) serves as individual channels connected via nozzle communication channels to multiple nozzles 4 formed in the nozzle plate 1 from which ink droplets are ejected. The fluid resistance portions 7 serve as supply channels to supply ink to the pressure chambers 6 while applying resistance to ink. The connecting portions 8 are connected to the pressure chambers 6 via the fluid resistance portions 7. From common chambers 10 formed in common-chamber formation members 20, ink is supplied to the connecting portions 8 through supply ports 9 formed in the diaphragm member 2.

For the channel member 1, a SUS substrate is etched with an acidic etching solution or machined by e.g., punching or pressing to form the pressure chambers 6, resistance portions 7, and the connecting portions 8. The channel member 1 may be, e.g., a silicon substrate.

The diaphragm member 2 includes a first layer 2A and a second layer 2B. A thin portion of the diaphragm member 2 is formed of the first layer 2A, and a thick portion of the diaphragm member 2 is formed of the first layer 2A and the second layer 2B. The diaphragm member 2 includes a plurality of vibration areas (diaphragm portions) 2*a* formed of the first layer 2A and forming part of walls of the corresponding pressure chambers 6. First convex portions 2*b* formed of the thick portions (formed of the first layer 2A and the second layer 2B) at an outer surface of the vibration areas 2*a* (opposite an inner surface of the vibration areas 2*a* facing the pressure chambers 6) are arranged in islands on the vibration areas 2*a*. On the convex portions 2*b* are disposed piezoelectric actuators 100 including electro-mechanical transducers serving as driving units (actuator units or pressure generation units) to deform the vibration areas 2*a*.

The piezoelectric actuators 100 includes a plurality of (two in FIG. 1) laminated piezoelectric members 12 bonded on a base member 13 with glue. Each of the piezoelectric members 12 is groove-processed by half-cut dicing to form a desired number of the piezoelectric pillars 12A and 12B at certain intervals in the form of comb. The piezoelectric pillars 12A and 12B of the piezoelectric members 12 have substantially identical configurations and differ in that driving waveform is applied to the piezoelectric pillars 12A so that the piezoelectric pillars 12A act as driven piezoelectric pillars and no driving waveform is applied to the piezoelectric pillars 12B so that the piezoelectric pillars 12B act as non-driven piezoelectric pillars and are used simply as support pillars. In FIG. 1, a top face (bonded face) of each of the driven piezoelectric pillar 12A is bonded to the corresponding one of the convex portions 2*b* of the diaphragm member 2.

In the piezoelectric members 12, piezoelectric layers and internal electrodes are alternately laminated and the internal electrodes are led to lateral end faces and connected to external electrodes. Further, flexible print circuits (FPCs) 15 serving as flexible power-feed member (wiring member) to transmit driving signals to the external electrodes of the driven piezoelectric pillars 12A are connected to the external electrodes.

The nozzle plate 3 is formed from a metal plate of, e.g., nickel (Ni) by electroforming. The nozzle plate 3 has the nozzles 4 of a diameter of, e.g., 10 to 35 μm corresponding to the respective pressure chambers 6 and is bonded to the channel member 1 with glue. A liquid-repellent layer is formed on a droplet-ejection face of the nozzle plate 3 (a front-side face in a direction in which ink droplets are ejected from the nozzle plate 3) opposite a face facing the pressure chambers 6.

The piezoelectric actuator 100 includes the piezoelectric members 12, the base member 13, and the FPCs 15. At the outer side of the piezoelectric actuator 100 are provided the common-chamber formation members 20 that are formed of, for example, laminated SUS materials. The above-mentioned common chambers 10 are formed in the common-chamber formation members 20. Frame members 21 are bonded to the common-chamber formation member 20, and supply ports 19 are formed in the frame members 21 to supply ink or other recording liquid from external ink-supply sources to the common chambers 10 and connected to the ink-supply sources, such as ink cartridges and sub tanks. The supply ports 19 are disposed at end portions or a middle portion of the frame members 21 in the nozzle array direction.

In the liquid ejection head having such a configuration, for example, when the head is driven according to a so-called push ejection method, a controller causes driving pulse voltages of, e.g., 20V to 50V to be selectively applied to the driven piezoelectric pillars 12A in accordance with a desired image to be recorded. As a result, the driven piezoelectric pillars 12A are deformed so as to deform the vibration areas 2*a* of the diaphragm member 2 toward the nozzle plate 3. Thus, the capacity (volume) of the pressure chambers 6 is changed to pressurize liquid in the pressure chambers 6, thus ejecting liquid droplets from the nozzles 4 of the nozzle plate 3. When liquid droplets are ejected from the nozzles 4, the internal pressure of the pressure chambers 6 decreases and a slight amount of negative pressure is generated in the pressure chambers 6 by a liquid flow created by the droplet ejection. At this state, when the application of voltage to the driven piezoelectric pillars 12A is turned off, the diaphragm member 2 returns to the original position and the pressure chambers 6 restores the original shape, thus generating additional negative pressure. At this time, ink is replenished from the common chambers 10 to the pressure chambers 6, and ink droplets are ejected from the nozzles 4 by the following driving-pulse application.

Instead of the above-described push ejection method, for example, a pull ejection method (in which the diaphragm member 2 is pulled and released so as to pressurize ink by the restoration force) or a pull-push ejection method (in which the diaphragm member 2 is held at an intermediate position, pulled from the position, and pushed in the droplet-ejection direction) may be employed.

Next, a configuration of a damper of the liquid ejection head is described with reference to FIG. 3.

Figure 3:
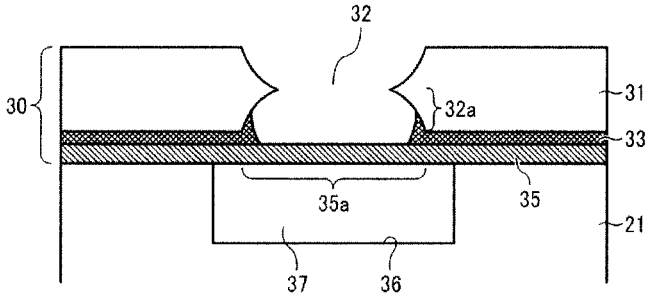
FIG. 3 is an enlarged view of a damper section of the liquid ejection head of FIG. 1.

FIG. 3 is an enlarged view of a portion of the damper. A thin-film support member 31 is one laminated member forming the laminated common-chamber formation member 20 and has an opening 32 forming part of the common chamber 10. A flexible thin-film member 35 is formed of a resin film to seal one side of the opening 32 and bonded to the thin-film support member 31 with glue 33. A damper formation member 30 collectively refers to the thin-film member 35 supported on the thin-film support member 31 with the glue 33.

The thin-film member 35 of the damper formation member 30 forms part of a wall face of the common chamber 10. The frame member 21 has a recessed portion 36 opposing the opening 32 via the thin-film member 35 to form an air room 37.

The thin-film member 35 is preferably made of a thin resin material to achieve desired performance as a free vibration face for minimizing and absorbing fluctuations in the internal pressure of the common chamber 10. For example, the thin resin material may be, e.g., polyphenylene sulfide (PPS) (trade name: "Torelina" manufactured by Toray Industries, Inc.) or polyimide (trade name: "Kapton" manufactured by Du Pont-Toray Co., Ltd).

The opening 32 of the thin-film support member 31 is formed by etching the thin-film support member 31 from both faces and has a portion 32*a* that is broad at an area proximal to a first surface of the thin-film support member 31 bonded to the thin-film member 35 and becomes narrower as an area of the recessed portion 36 is more distant from the first surface of the thin-film support member 31.

The glue 33 for bonding the thin-film member 35 to the thin-film support member 31 is not spread into an area other than a peripheral area of an opposing portion 35*a* of the thin-film member 35 opposing the opening 32.

With such a configuration, when fluctuations in the internal pressure of the common chamber 10 occur, the thin-film member 35 deforms to minimize or absorb the fluctuations, thus stabilizing droplet ejection performance.

As described above, in this exemplary embodiment, the glue 33 is not spread to the area other than the peripheral area of the opposing portion 35*a* of the thin-film member 35 opposing the opening 32. Such a configuration prevents unintended increase of the hardness of a portion serving as the damper of the thin-film member 35 due to the glue 33 or deformation caused by a difference in linear expansion coefficient between the thin-film member 35 and the glue 33, thus obtaining stable damper performance.

Next, a liquid ejection head according to a second exemplary embodiment of this disclosure is described with reference to FIG. 4.

Figure 4:
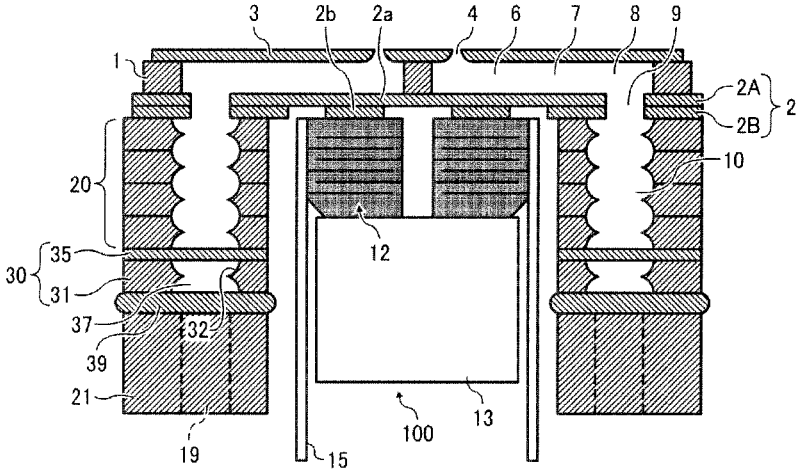
FIG. 4 is a cross-sectional view of a liquid ejection head according to a second exemplary embodiment.

FIG. 4 is a cross-sectional view of the liquid ejection head according to the second exemplary embodiment. In this exemplary embodiment, each thin-film support member 31 bonded to a corresponding thin-film member 35 forming a wall face of a common chamber 10, that is, each damper formation member 30 is disposed between a common-chamber formation member 20 and a frame member 21. As with the first exemplary embodiment, the thin-film support member 31 has an opening 32 to form an air room 37. The thin-film member 35 is bonded to the thin-film support member 31 with glue in the same manner as the above-described first exemplary embodiment, thus obtaining effects equivalent to those of the first exemplary embodiment.

In such a configuration, in a case in which the thin-film support member 31 is made of metal or ceramics to enhance the hardness, the thin-film support member 31 tends to have a coefficient of thermal expansion considerably differing from that of the frame member 21 formed by typical resin molding. Therefore, as illustrated in FIG. 4, elastic glue 39 is preferably applied between the thin-film support member 31 and the frame member 21 to bond the thin-film support member 31 to the frame member 21.

Next, a liquid ejection head according to a third exemplary embodiment of this disclosure is described with reference to FIGS. 5 and 6.

Figure 5:
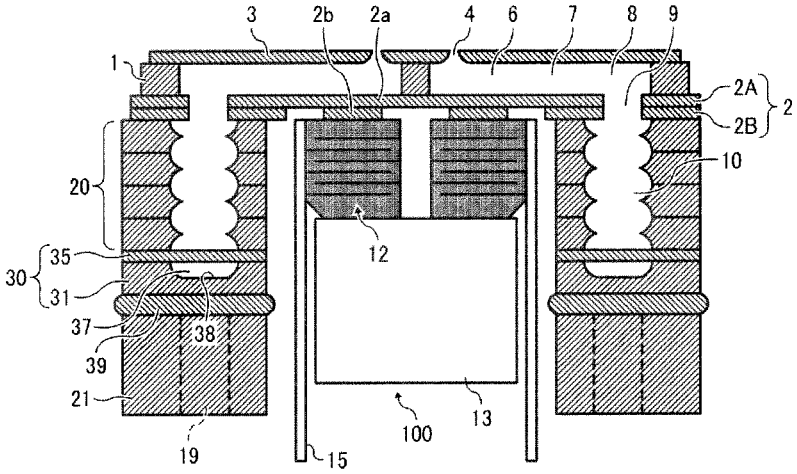
FIG. 5 is a cross-sectional view of a liquid ejection head according to a third exemplary embodiment.
Figure 6:
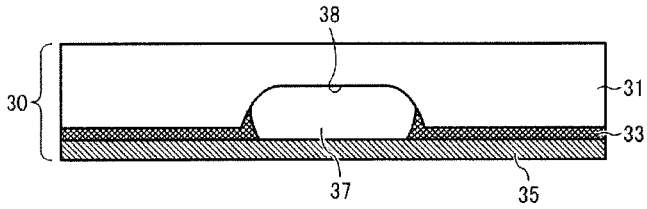
FIG. 6 is an enlarged view of a damper section of the liquid ejection head of FIG. 5.

FIG. 5 is a cross-sectional view of the liquid ejection head. FIG. 6 is an enlarged view of a damper section of the liquid ejection head illustrated in FIG. 5.

As with the above-described second exemplary embodiment, in this exemplary embodiment, each thin-film support member 31 bonded to a corresponding thin-film member 35 forming a wall face of a common chamber 10, that is, each damper formation member 30 is disposed between a common-chamber formation member 20 and a frame member 20. The thin-film support member 31 has a recessed portion 38 that is broad at an area proximal to a first surface of the thin-film support member 31 bonded to the thin-film member 35 and becomes narrower as an area of the recessed portion 38 is more distant from the surface of the thin-film support member 31. The recessed portion 38 forms an air room 37. The thin-film member 35 is bonded to the thin-film support member 31 with glue in the same manner as the above-described first exemplary embodiment, thus obtaining effects equivalent to those of the first exemplary embodiment.

Next, a liquid ejection head according to a fourth exemplary embodiment of this disclosure is described with reference to FIG. 7.

Figure 7:
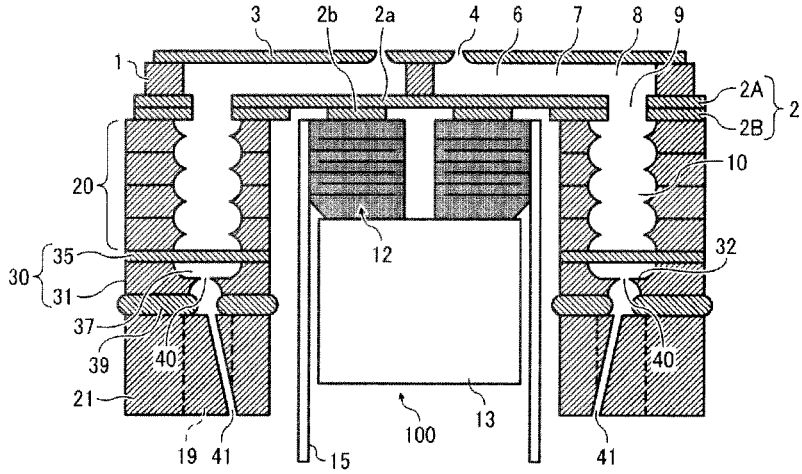
FIG. 7 is a cross-sectional view of a liquid ejection head according to a fourth exemplary embodiment.

FIG. 7 is a cross-sectional view of the liquid ejection head according to the fourth exemplary embodiment. In this exemplary embodiment, each thin-film support member 31 bonded to a corresponding thin-film member 35 forming a wall face of a common chamber 10, that is, each damper formation member 30 is disposed between a common-chamber formation member 20 and a frame member 21. As with the third exemplary embodiment, the thin-film support member 31 has an opening 32 to form an air room 37.

In addition, in the thin-film support member 31, a through hole 40 having a cross sectional area smaller than the opening 32 is formed to communicate the opening 32 with a second surface of the thin-film support member 31 opposite a first surface of the thin-film support member 31 bonded to the thin-film member 35. The through hole 40 communicates ambient air via an ambient-air communication hole 41 formed in the frame members 21. The thin-film member 35 is bonded to the thin-film support member 31 with glue in the same manner as the above-described first exemplary embodiment, thus obtaining effects equivalent to those of the first exemplary embodiment.

In addition, as described above, the cross-sectional area of the through hole 40 is set to be smaller than the opening 32 (a side of the thin-film support member 31 close to the thin-film member 35), thus extending an area in which the elastic glue 39 can be applied. The elastic glue 39 need to have a certain amount of thickness to perform the function of reducing the difference in heat expansion coefficient, thus hampering high-precision micro-pattern application. Meanwhile, as for the bonded area between the common-chamber formation member 20 and the damper formation member 30 opposing it, only a minimum area is obtained because of downsizing of the head. Consequently, if the common-chamber formation member 20 and the damper formation member 30 are bonded with the elastic glue 39 at an open state similar to the opening 32, it may be difficult to obtain a sufficient reliability for the bonding. By contrast, in this exemplary embodiment, the cross-sectional area of the through hole 40 is set smaller than the opening 32 to obtain a larger bonding area of the elastic glue 39, thus improving the bonding reliability.

In addition, the opening 32 (the air room 37) communicates ambient air, thus maintaining a stable damper performance without changing damper characteristics due to fluctuations in temperature and atmospheric pressure.

Next, a liquid ejection head according to a fifth exemplary embodiment of this disclosure is described with reference to FIG. 8.

Figure 8:
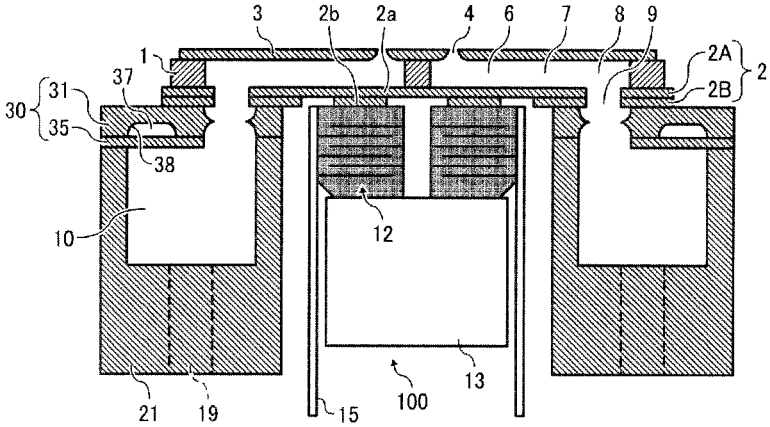
FIG. 8 is a cross-sectional view of a liquid ejection head according to a fifth exemplary embodiment.

FIG. 8 is a cross-sectional view of the liquid ejection head according to the fifth exemplary embodiment. In this exemplary embodiment, each thin-film support member 31 bonded to a corresponding thin-film member 35 forming a wall face of a common chamber 10, that is, each damper formation member 30 is disposed between a diaphragm member 2 and a frame member 21. The thin-film support member 31 has a recessed portion 38 of a shape similar to that of the above-described third exemplary embodiment to form an air room 37. The thin-film member 35 is bonded to the thin-film support member 31 with glue in the same manner as the above-described first exemplary embodiment, thus obtaining effects equivalent to those of the first exemplary embodiment. The damper formation member 30 also serves as a portion of the common chamber 10, thus reducing the number of components and cost.

Next, a liquid ejection head according to a sixth exemplary embodiment of this disclosure is described with reference to FIGS. 9 and 10.

Figure 9:
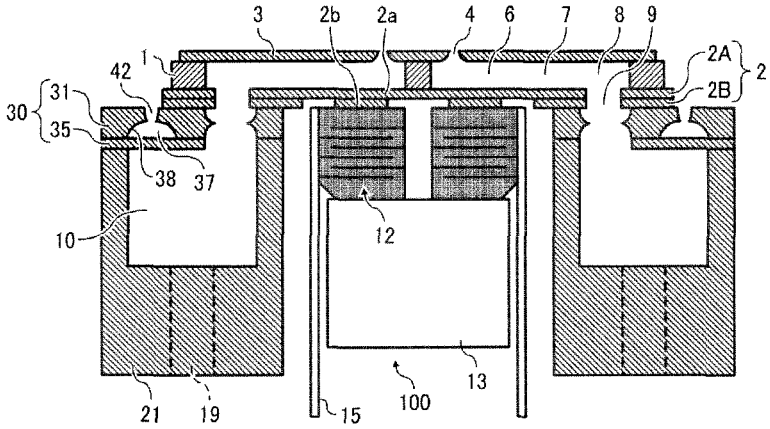
FIG. 9 is a cross-sectional view of a liquid ejection head according to a sixth exemplary embodiment.
Figure 10:
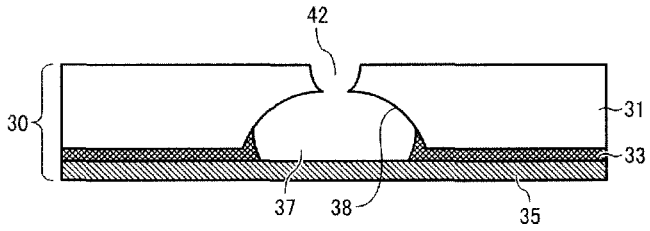
FIG. 10 is an enlarged view of a damper section of the liquid ejection head of FIG. 9.

FIG. 9 is a cross-sectional view of the liquid ejection head. FIG. 10 is an enlarged view of a damper section of the liquid ejection head illustrated in FIG. 9.

In this exemplary embodiment, each thin-film support member 31 bonded to a corresponding thin-film member 35 forming a wall face of a common chamber 10, that is, each damper formation member 30 is disposed between a diaphragm member 2 and a frame member 21. The thin-film support member 31 has a recessed portion 38 of a shape similar to that of the above-described third exemplary embodiment to form an air room 37. The recessed portion 38 has an air vent hole 42 communicating ambient air at a side opposite a side facing the thin-film member 35. The thin-film member 35 is bonded to the thin-film support member 31 with glue in the same manner as the above-described first exemplary embodiment, thus obtaining effects equivalent to those of the first exemplary embodiment. The air room 37 communicates ambient air via the air vent hole 42, thus maintaining stable damper performance.

Next, a liquid ejection head according to a seventh exemplary embodiment of this disclosure is described with reference to FIG. 11.

Figure 11:
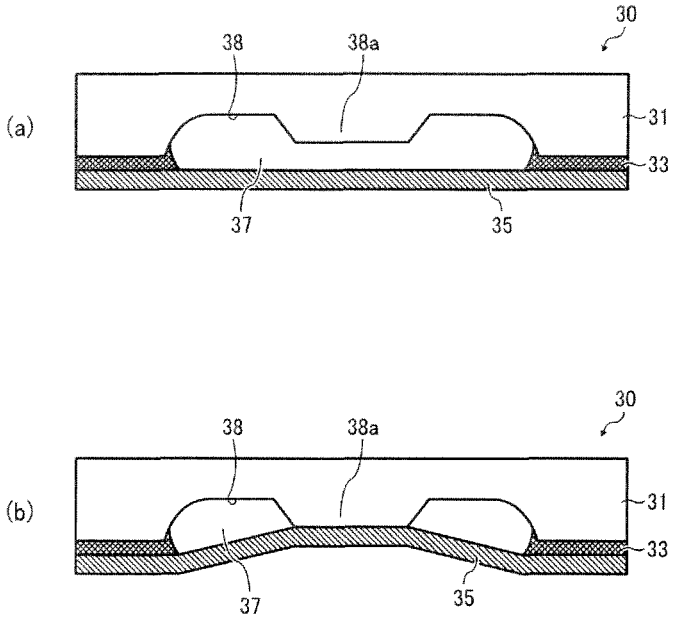
FIG. 11 is an enlarged view of a damper section of a liquid ejection head according to a seventh exemplary embodiment.

FIG. 11 is an enlarged view of a portion of a damper section of the liquid ejection head. In this exemplary embodiment, a thin-film support member 31 of a damper formation member 30 has a recessed portion 38, and a convex portion 38*a* is formed in a part of the recessed portion 38.

With such a configuration, even if a large amount of pressure is applied against the thin-film member 35, as illustrated in FIG. 11*b*, the convex portion 38*a* restricts deformation of the thin-film member 35, thus preventing breakage of the thin-film member 35.

Next, a first example of a method of making a liquid ejection head according to an exemplary embodiment of this disclosure is described with reference to FIG. 12.

As illustrated in FIG. 12*a*, a thin-film support member 31 made of a SUS substrate is etched in one direction to from an opening 32 and, as illustrated in FIG. 12*b*, glue 33 is applied to an area except for the opening 32 of a surface of the thin-film support member 31 bonded to a thin-film member 35.

Meanwhile, as illustrated in FIG. 12*c*, the thin-film member 35 is bonded to a slightly-adhesive film (carrier sheet) 50 to from a bonded film member 51. The thin-film member 35 bonded to the slightly-adhesive film 50 has an improved handling performance, thus allowing the thin-film support member 31 to be bonded to the thin-film member that may be difficult to deal with as a single member. The bonding of the thin-film member 35 and the slightly-adhesive film 50 may be performed at a large scale by using rolled materials.

The bonded film member 51 formed by bonding the slightly-adhesive film 50 to the thin-film support member 31 can be formed in a desired bonded shape by pressing or other processing. For example, alignment holes may be formed to position the thin-film support member 31 in bonding.

As illustrated in FIG. 12*d*, in the form of the bonded film member 51, the thin-film member 35 is bonded with the glue 33 to a surface of the thin-film support member 31 to seal the opening 32.

Then, as illustrated in FIG. 12*e*, after the glue 33 is preliminarily or fully hardened, the slightly-adhesive film 50 is separated from the thin-film member 35 to from the thin-film member 35 bonded to the thin-film support member 31. Such a process minimizes spreading of the glue 33 to an area other than a peripheral area of a portion of the thin-film member 35 corresponding to the opening 32. In other words, such a process minimizes spreading of the glue 33 to a portion of the thin-film member 35 corresponding to the opening 32 over a peripheral area of the portion of the thin-film member 35.

Figure 13:
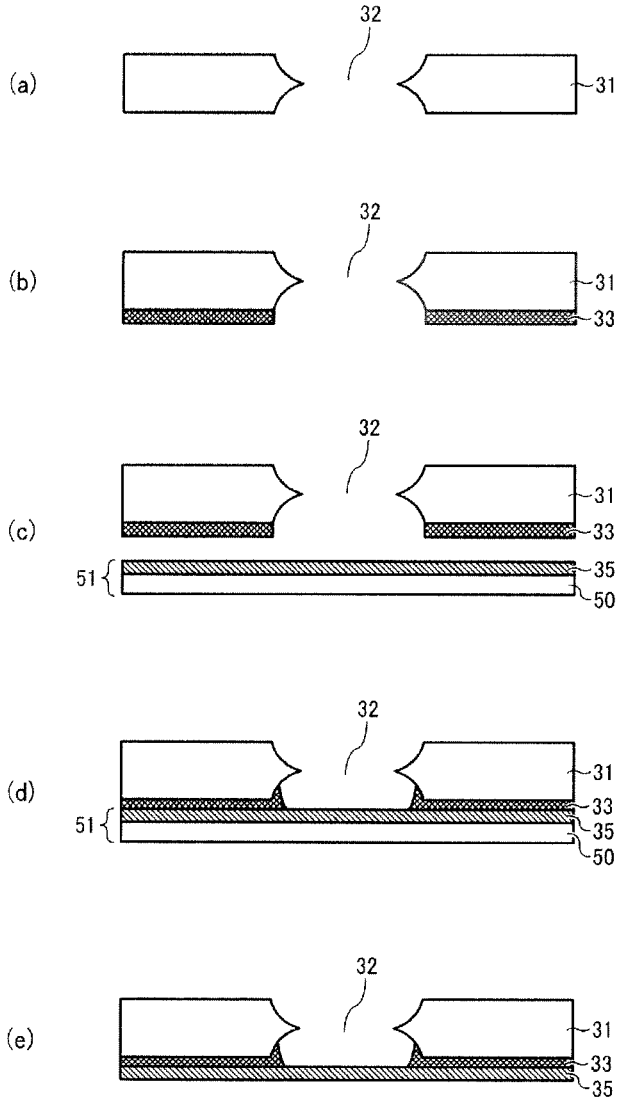
FIG. 13 is a schematic view of a second example of a method of making a liquid ejection head according to an exemplary embodiment.

Next, a second example of a method of making a liquid ejection head according to an exemplary embodiment of this disclosure is described with reference to FIG. 13.

Figure 12:
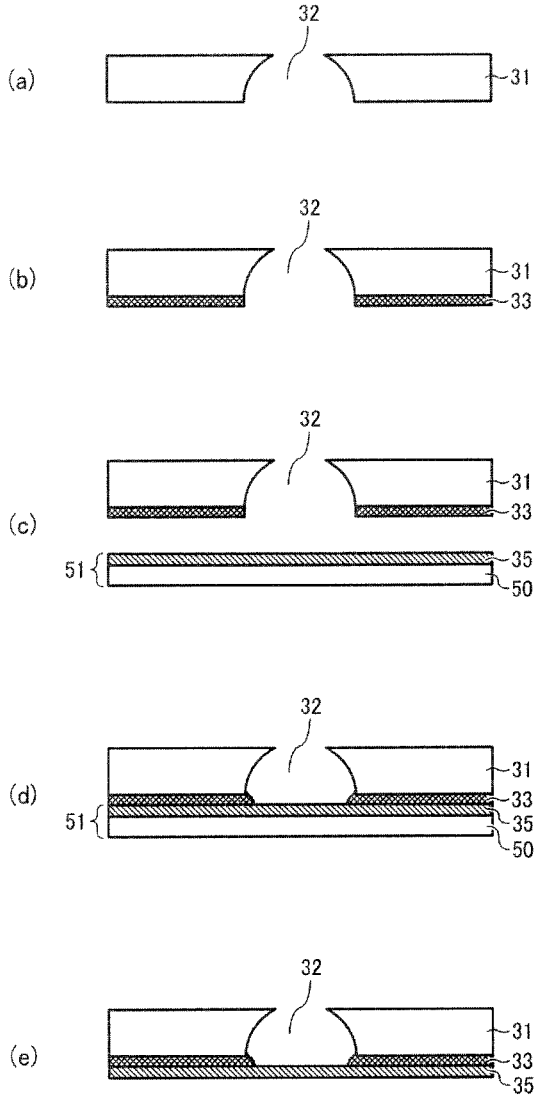
FIG. 12 is a schematic view of a first example of a method of making a liquid ejection head according to an exemplary embodiment.

As illustrated in FIG. 13*a*, this example differs from the first example of FIG. 12 only in that a thin-film support member 31 made of a SUS substrate is etched in two directions to from an opening 32, and descriptions of the processing steps are omitted to avoid redundancy.

As described above, the method of making the liquid ejection head includes applying glue to an area except for the opening or recessed portion of a surface of the thin-film support member on which the thin-film member is bonded, bonding the thin-film member bonded to the slightly-adhesive film to the surface of the thin-film support member with the glue to seal the opening or recessed portion of the thin-film support member, and separating the slightly-adhesive film from thin-film member in a state in which the glue is preliminarily or fully hardened. Such a configuration can easily obtain a liquid ejection head in which the glue for bonding the thin-film member the thin-film support member is not on an area other than a peripheral area of a portion of the thin-film member corresponding to the opening or recessed portion of the thin-film support member.

Figure 14:
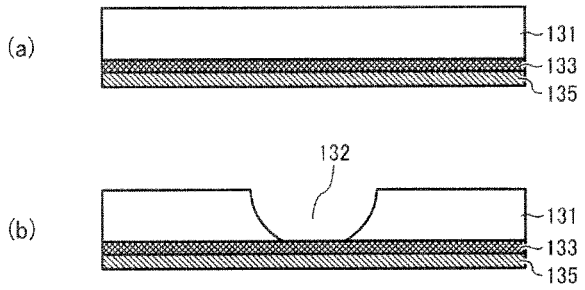
FIG. 14 is a schematic view of a first comparative example of a method of making a liquid ejection head.
Figure 15:
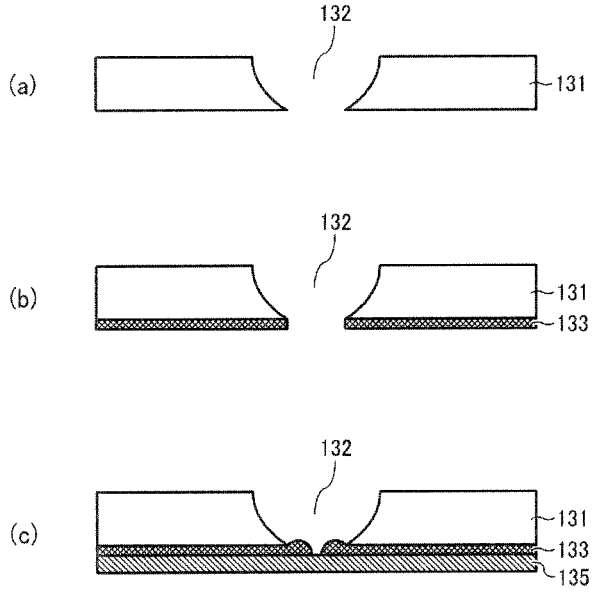
FIG. 15 is a schematic view of a second comparative example of a method of making a liquid ejection head.

Next, a comparative example of a method of making a liquid ejection head is described with reference to FIGS. 14 and 15.

In a first comparative example, as illustrated in FIG. 14*a*, a thin-film support member 131 is bonded to a thin-film member 135 with glue 133 to form a member (clad member) 130. As illustrated in FIG. 14*b*, the thin-film support member 131 is etched in one direction to form an opening 132. Even in a case of using the thin-film member 135, as described above, a plate material not subjected to three-dimensional machining can be relatively easily bonded to the thin-film member 135. After bonding, the thin-film member 135 can be handled together with the thin-film support member 131 as an integrated member, thus providing preferable handling performance.

However, in such a method, the opening 132 becomes narrower as an area of the opening 132 approaches the thin-film member 135 and broader as it goes away from the thin-film member 135. In other words, a portion (damper portion) of the opening 32 that functions as a damper is relatively narrow, and an area to be removed by etching need be extended to broaden the damper portion. In addition, the glue 133 remains on an entire area of the thin-film member 135 facing the opening 132, thus hampering stable damper performance.

Next, in a second comparative example, as illustrated in FIG. 15*a*, a thin-film support member 131 is etched in one direction to form an opening 132. Then, as illustrated in FIG.

15*b*, glue 133 is applied to the thin-film support member 131 and, as illustrated in FIG. 15*c*, a thin-film member 135 is bonded to the thin-film support member 131 with the glue 133.

However, because the thin-film member 135 is a thin film of, e.g., approximately 2 μm, if only the thin-film member 135 is bonded to the thin-film support member 131, it is difficult to handle the thin-film member 135, causing cocking or other failure.

By contrast, in the above-described exemplary embodiments, the thin-film member bonded to the slightly-adhesive film is bonded with the glue to a surface of thin-film support member to seal the opening or recessed portion of thin-film support member. In a state in which the glue is preliminarily or fully hardened, the slightly-adhesive film is separated from the thin-film member. Such a configuration facilitates handling of the thin-film member, thus preventing or minimizing cockling and achieving high-quality bonding.

Next, an image forming apparatus having a liquid ejection head according to an exemplary embodiment of this disclosure is described with reference to FIGS. 16 and 17.

Figure 16:
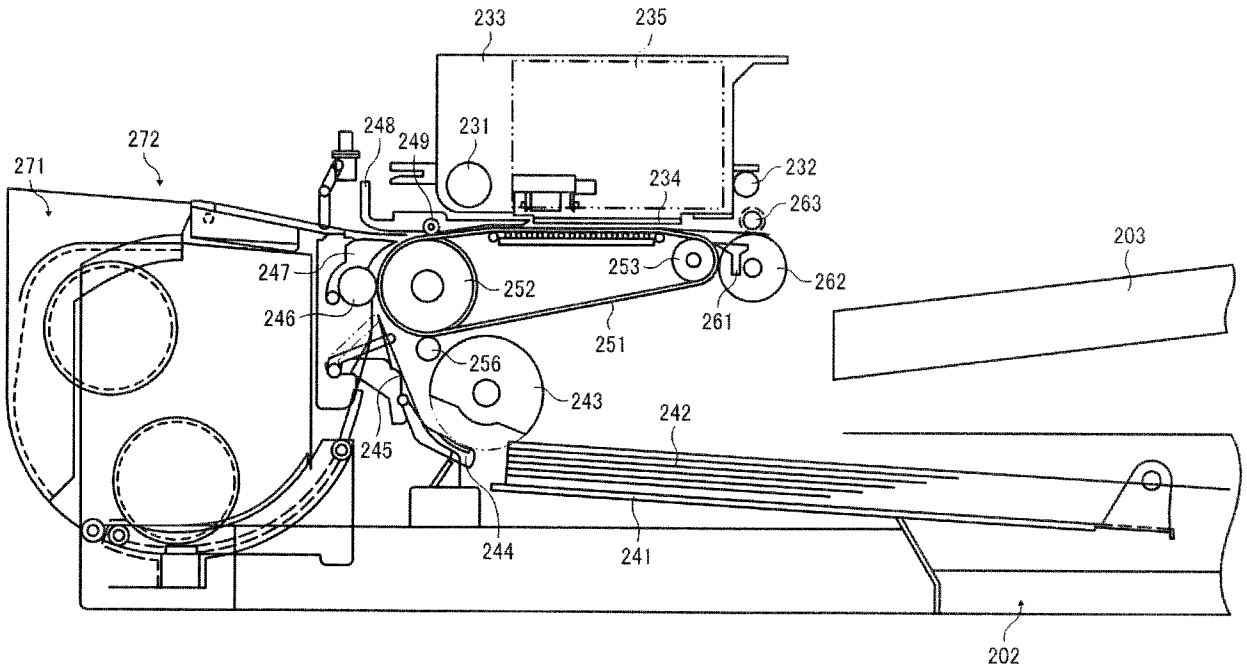
FIG. 16 is a schematic side view of a mechanical section of an image forming apparatus including liquid ejection heads according to an exemplary embodiment of this disclosure.

FIG. 16 is a schematic side view of a mechanical section of the image forming apparatus. FIG. 17 is a plan view of a portion of the mechanical section of FIG. 16.

The image forming apparatus is a serial-type image forming apparatus and includes a main left-side plate 221A, a main right-side plate 221B, a main guide rod 231, a sub guide rod 232, and a carriage 233. The main guide rod 231 and the sub guide rod 232 serving as guide members extend between the main side plates 221A and 221B to support the carriage 233. The carriage 233 supported by the main guide rod 231 and the sub guide rod 232 is slidable in a main scanning direction indicated by a double arrow MSD in FIG. 17. The carriage 233 is reciprocally moved for scanning in the main scanning direction MSD by a main scanning motor via a timing belt.

On the carriage 233 is mounted a recording head assembly 234 serving as a liquid ejection head unit according to an exemplary embodiment of this disclosure to eject ink droplets of different colors, for example, yellow (y), cyan (c), magenta (m), and black (k). The recording head assembly 234 is installed to the carriage 233 so that multiple nozzle rows each including multiple nozzles are arranged parallel to a sub scanning direction (indicated by an arrow SSD illustrated in FIG. 17) perpendicular to the main scanning direction MSD and ink droplets are ejected downward from the nozzles.

The recording head assembly 234 includes a liquid ejection head 234*a*, a liquid ejection head 234*b*, and a base member. Each of the liquid ejection head 234*a* and the liquid ejection head 234*b* includes, for example, two nozzle rows and is mounted to the base member. For example, the liquid ejection head 234*a* ejects black ink droplets from one of the nozzle rows and cyan ink droplets from the other of the nozzle rows, and the liquid ejection head 234*b* ejects magenta ink droplets from one of the nozzle rows and yellow ink droplets from the other of the nozzle rows. In the above-description, the recording head assembly 234 has two heads for ejecting liquid droplets of four colors. However, it is to be noted that the recording head assembly 234 may be include, for example, four liquid ejection heads for separately eject ink droplets of four different colors.

On the carriage 233 are mounted sub tanks 235*a* and 235*b* (collectively referred to as sub tanks 235 unless distinguished) to supply different color inks corresponding to the respective nozzle rows of the recording head assembly 234. A supply unit 224 replenishes different color inks from corresponding ink cartridges 210 to the sub tanks 235 via supply tubes 236 for the respective color inks.

The image forming apparatus further includes a sheet feed section that feeds sheets 242 stacked on a sheet stack portion (platen) 241 of a sheet feed tray 202. The sheet feed section further includes a sheet feed roller 243 that separates the sheets 242 from the sheet stack portion 241 and feeds the sheets 242 sheet by sheet and a separation pad 244 that is disposed opposing the sheet feed roller 243. The separation pad 244 is made of a material of a high friction coefficient and biased toward the sheet feed roller 243.

To feed the sheet 242 from the sheet feed section to a portion below the recording head assembly 234, the image forming apparatus includes a first guide member 245 that guides the sheet 242, a counter roller 246, a conveyance guide member 247, a press member 248 including a front-end press roller 249, and a conveyance belt 251 that conveys the sheet 242 to a position facing the recording head assembly 234 with the sheet 242 electrostatically attracted thereon.

The conveyance belt 251 is an endless belt that is looped between a conveyance roller 252 and a tension roller 253 so as to circulate in a belt conveyance direction, that is, the sub-scanning direction (SSD). A charge roller 256 is provided to charge the surface of the conveyance belt 251. The charge roller 256 is disposed to contact the surface of the conveyance belt 251 and rotated by the circulation of the conveyance belt 251. By rotating the conveyance roller 252 by a sub-scanning motor, not illustrated, via a timing roller, the conveyance belt 251 circulates in the belt conveyance direction SSD illustrated in FIG. 17.

The image forming apparatus further includes a sheet output section to output the sheet 242 having an image formed by the recording heads 234. The sheet output section includes a separation claw 261 to separate the sheet 242 from the conveyance belt 251, a first output roller 262, a second output roller 263, and the sheet output tray 203 disposed below the first output roller 262.

A duplex unit 271 is removably mounted on a rear portion of the image forming apparatus. When the conveyance belt 251 rotates in reverse to return the sheet 242, the duplex unit 271 receives the sheet 242 and turns the sheet 242 upside down to feed the sheet 242 between the counter roller 246 and the conveyance belt 251. At the top face of the duplex unit 271 is formed a manual-feed tray 272.

Figure 17:
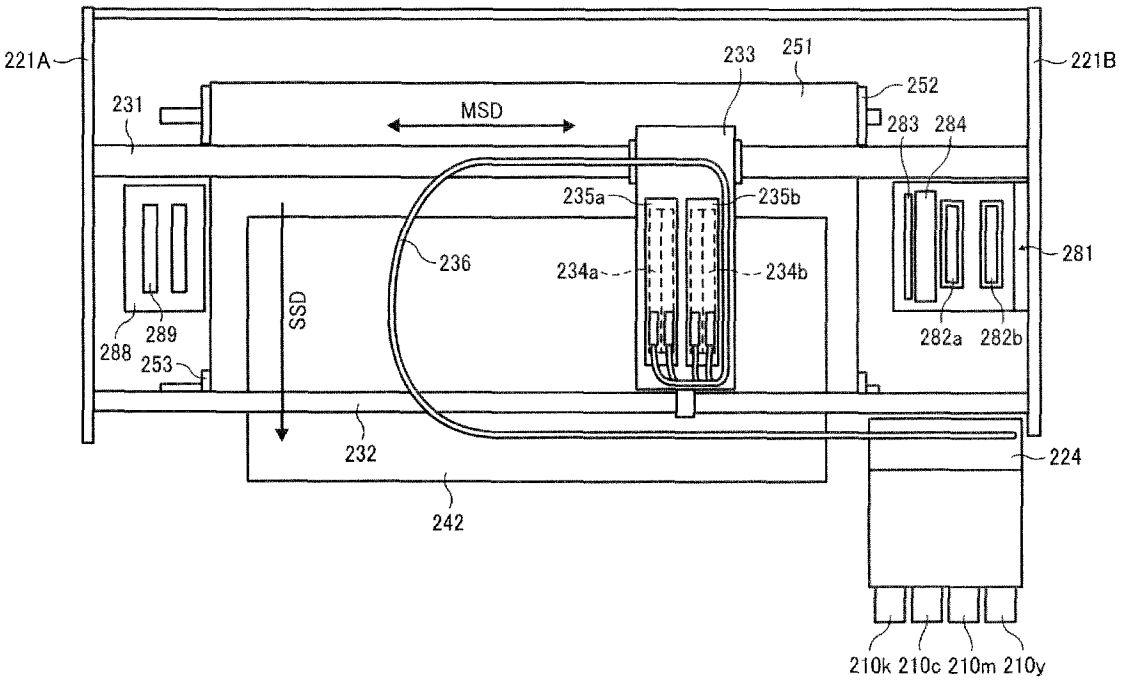
FIG. 17 is a schematic plan view of the mechanical section of FIG. 16.

In FIG. 17, at a non-print area on one end in the main-scanning direction MSD of the carriage 233 is disposed a maintenance unit 281 to maintain and recover conditions of the nozzles of the recording head assembly 234. The maintenance unit 281 includes cap members 282*a* and 282*b* (hereinafter collectively referred to as "caps 282" unless distinguished) to cover nozzle faces of the recording head assembly 234, a wiping blade 283 serving as a blade member to wipe the nozzle faces of the recording head assembly 234, and a first droplet receptacle 284 to store ink droplets during maintenance ejection performed to discharge viscosity-increased ink.

In FIG. 17, a second droplet receptacle 288 is disposed at a non-print area on the other end in the main-scan direction MSD of the carriage 233. The second droplet receptacle 288 stores viscosity-increased ink or other non-recorded ink droplets discharged during recording (image forming) operation and so forth. The second droplet receiver 288 has openings 289 arranged in parallel with the nozzles rows of the recording head assembly 234.

In the image forming apparatus having the above-described configuration, the sheets 242 are separated sheet by sheet from the sheet feed tray 202, fed in a substantially vertically upward direction, guided along the first guide member 245, and conveyed with sandwiched between the conveyance belt 251 and the counter roller 246. Further, the front tip of the sheet 242 is guided with the conveyance guide 247 and pressed with the front-end press roller 249 against the conveyance belt 251 so that the traveling direction of the sheet 242 is turned substantially 90 angle degrees.

At this time, plus outputs and minus outputs, i.e., positive and negative supply voltages are alternately applied to the charge roller 256 so that the conveyance belt 251 is charged with an alternating voltage pattern, that is, an alternating band pattern of positively-charged areas and negatively-charged areas in the sub-scanning direction SSD, i.e., the belt circulation direction. When the sheet 242 is fed onto the conveyance belt 251 alternately charged with positive and negative charges, the sheet 242 is electrostatically attracted on the conveyance belt 251 and conveyed in the sub-scanning direction SSD by circulation of the conveyance belt 251.

By driving the recording head assembly 234 in response to image signals while moving the carriage 233, ink droplets are ejected on the sheet 242 stopped below the recording head assembly 234 to form one band of a desired image. Then, the sheet 242 is fed by a certain amount to prepare for recording another band of the image. Receiving a signal indicating that the image has been recorded or the rear end of the sheet 242 has arrived at the recording area, the recording head assembly 234 finishes the recording operation and outputs the sheet 242 to the sheet output tray 203.

As described above, the image forming apparatus includes liquid ejection heads according to the present exemplary embodiment as the recording heads, thus obtaining stable droplet ejection performance and high-quality images.

In the above-described exemplary embodiments, the image forming apparatus is described as a serial-type image forming apparatus. However, it is to be noted that the image forming apparatus is not limited to such printers and may be, for example, a line-type image forming apparatus. Further, the image forming apparatus may be an image forming apparatus using, for example, a recording liquid other than "ink" in strict meaning or a fixing solution.

The damper formation member described in any of the above-described exemplary embodiments can be also used as, for example, a damper for minimizing fluctuations in internal pressure of a liquid containing portion of a head tank to supply liquid to a liquid ejection head.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid ejection head comprising:

a common-chamber formation member including a common chamber to supply liquid to a plurality of pressure chambers communicating a plurality of nozzles for ejecting liquid droplets;

a flexible thin-film member to form part of a wall face of the common chamber; and a thin-film support member bonded to the thin-film member with glue, wherein the thin-film support member has one of an opening and a recessed portion at least partially having a shape that is broad in an area proximal to a first surface of the thin-film support member bonded to the thin-film member and becomes narrower as an area of the one of the opening and the recessed portion is more distant from the first surface of the thin-film support member bonded to the thin-film member, the one of the opening and the recessed portion of the thin-film support member is sealed with the thin-film member, and a portion of the thin-film member corresponding to the one of the opening and the recessed portion of the thin-film support member has the glue on only a periphery area of the portion of the thin-film member that contacts the thin-film support member.

2. The liquid ejection head according to claim 1, wherein the recessed portion partially has the shape that is broad at the area proximal to the first surface of the thin-film support member bonded to the thin-film member and becomes narrower as an area of the one of the opening and the recessed portion is more distant from the first surface of the thin-film support member bonded to the thin-film member, and the thin-film support member has a through hole having a cross-sectional area smaller than a cross-sectional area of the recessed portion, the through hole communicating the recessed portion with a second surface of the thin-film support member opposite the first surface of the thin-film support member bonded to the thin-film member.

3. The liquid ejection head according to claim 2, wherein the through hole communicates the recessed portion with ambient air.

4. An image forming apparatus comprising a liquid ejection head, the liquid ejection head including:

a common-chamber formation member including a common chamber to supply liquid to a plurality of pressure chambers communicating a plurality of nozzles for ejecting liquid droplets;

a flexible thin-film member to form part of a wall face of the common chamber; and a thin-film support member bonded to the thin-film member with glue, wherein the thin-film support member has one of an opening and a recessed portion at least partially having a shape that is broad in an area proximal to a first surface of the thin-film support member bonded to the thin-film member and becomes narrower as an area of the one of the opening and the recessed portion is more distant from the first surface of the thin-film support member bonded to the thin-film member, the one of the opening and the recessed portion of the thin-film support member is sealed with the thin-film member, and a portion of the thin-film member corresponding to the one of the opening and the recessed portion of the thin-film support member has the glue on only a periphery area of the portion of the thin-film member that contacts the thin-film support member.

5. The image forming apparatus according to claim 4, wherein the recessed portion partially has the shape that is broad at the area proximal to the first surface of the thin-film support member bonded to the thin-film member and becomes narrower as an area of the one of the opening and the recessed portion is more distant from the first surface of the thin-film support member bonded to the thin-film member, and the thin-film support member has a through hole having a cross-sectional area smaller than a cross-sectional area of the recessed portion, the through hole communicating the recessed portion with a second surface of the thin-film support member opposite the first surface of the thin-film support member bonded to the thin-film member.

6. The image forming apparatus according to claim 5, wherein the through hole communicates the recessed portion with ambient air.

7. A method of making a liquid ejection head having a common-chamber formation member including a common chamber to supply liquid to a plurality of pressure chambers communicating a plurality of nozzles for ejecting liquid droplets, a flexible thin-film member to form part of a wall face of the common chamber, and a thin-film support member bonded to the thin-film member with glue, the method comprising:

forming, in the thin-film support member, one of an opening and a recessed portion at least partially having a shape that is broad in an area proximal to a first surface of the thin-film support member bonded to the thin-film member and becomes narrower as an area of the one of the opening and the recessed portion is more distant from the first surface of the thin-film support member bonded to the thin-film member, applying the glue to an area other than the one of the opening and the recessed portion of the first surface of the thin-film support member bonded to the thin-film member;

bonding the thin-film member bonded to a slightly-adhesive film to the first surface of the thin-film support member to seal the one of the opening and the recessed portion of the thin-film support member; and separating the slightly-adhesive film from the thin-film member in a state in which the glue is preliminarily or fully hardened.

8. The method according to claim 7, further comprising forming, in the thin-film support member, a through hole having a cross-sectional area smaller than a cross-sectional area of the recessed portion so that the through hole communicates the recessed portion with a second surface of the thin-film support member opposite the first surface of the thin-film support member bonded to the thin-film member, wherein the recessed portion partially has the shape that is broad at the area proximal to the first surface of the thin-film support member bonded to the thin-film member and becomes narrower as an area of the one of the opening and the recessed portion is more distant from the first surface of the thin-film support member bonded to the thin-film member.

9. The liquid ejection head according to claim 1, wherein the one of the opening and the recessed portion has a shape that is broad at the area proximal to the first surface of the thin-film support member bonded to the thin-film member and becomes narrower as an area of the one of the opening and the recessed portion is more distant, in a direction that the thin-film support member is bonded to the thin-film member.

* * * * *